US008408183B2

(12) United States Patent
Johnson

(10) Patent No.: US 8,408,183 B2
(45) Date of Patent: Apr. 2, 2013

(54) IGNITION AND FUEL SHUTOFF FOR ENGINE

(75) Inventor: Robert Johnson, New Berlin, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 1030 days.

(21) Appl. No.: 12/419,458

(22) Filed: Apr. 7, 2009

(65) Prior Publication Data

US 2009/0260596 A1 Oct. 22, 2009

Related U.S. Application Data

(60) Provisional application No. 61/046,911, filed on Apr. 22, 2008.

(51) Int. Cl.

| | |
|---|---|
| ***F02P 5/00*** | (2006.01) |
| ***F02B 77/08*** | (2006.01) |
| ***F02D 17/00*** | (2006.01) |
| ***F02M 17/30*** | (2006.01) |

(52) U.S. Cl. ..... 123/406.74; 123/198 D

(58) Field of Classification Search ..... 123/198 D, 123/198 DB, 198 DC, 406.74

See application file for complete search history.

(56) References Cited

U.S. PATENT DOCUMENTS

| | | | | |
|---|---|---|---|---|
| 1,881,251 | A | 10/1932 | Tobener, Jr. | |
| 3,158,144 | A | 11/1964 | Walker | |
| 3,734,230 | A | 5/1973 | Tanaka | |
| 4,058,105 | A | 11/1977 | Schellin et al. | |
| 4,371,051 | A | 2/1983 | Achterholt | |
| 4,449,495 | A | 5/1984 | Fiala | |
| 4,510,739 | A | 4/1985 | Dluhosch | |
| 4,685,431 | A | 8/1987 | Kubota et al. | |
| 4,856,471 | A | 8/1989 | Pettinelli | |
| 5,720,250 | A | 2/1998 | Greppmair et al. | |
| 6,024,068 | A | 2/2000 | Nakase et al. | |
| 6,082,323 | A * | 7/2000 | Winberg | 123/198 DB |
| 6,213,083 | B1 * | 4/2001 | Winberg | 123/198 DB |
| 6,371,074 | B1 * | 4/2002 | Keller | 123/198 DB |
| 6,516,779 | B2 | 2/2003 | Ikeda | |
| 6,612,881 | B2 | 9/2003 | Kanno | |
| 6,640,770 | B2 * | 11/2003 | Woody | 123/198 D |
| 6,691,683 | B2 * | 2/2004 | Gracyalny et al. | 123/516 |
| 7,131,430 | B2 | 11/2006 | Rado et al. | |
| 7,165,536 | B2 | 1/2007 | Kirk et al. | |
| 7,231,900 | B1 * | 6/2007 | Hanshaw | 123/198 D |
| 2002/0112701 | A1 | 8/2002 | Gracyalny et al. | |
| 2006/0118075 | A1 | 6/2006 | Yamada | |
| 2007/0006840 | A1 | 1/2007 | Hedlund | |
| 2007/0234999 | A1 | 10/2007 | Tanaka et al. | |

FOREIGN PATENT DOCUMENTS

| | | |
|---|---|---|
| EP | 1104824 | 6/2001 |

* cited by examiner

*Primary Examiner* — Stephen K Cronin
*Assistant Examiner* — Sizo Vilakazi
(74) *Attorney, Agent, or Firm* — Michael Best & Friedrich LLP

(57) ABSTRACT

A carburetor assembly includes a carburetor, a fuel supply valve, a valve member and a normally open switch. The fuel supply valve is coupled to the carburetor housing and is fluidly connected to the carburetor. The fuel supply valve includes a lever pivotable between first and second positions. The valve member is configured to move in response to the lever such that fuel is allowed to flow to the carburetor when the lever is in the first position and fuel is not allowed to flow to the carburetor when the lever is in the second position. The normally open switch is adjacent the fuel supply valve and includes a switch actuator. The lever is configured to engage and release the switch actuator to move the switch actuator between a non-actuated position and an actuated position respectively when the lever moves between the first and second positions.

19 Claims, 4 Drawing Sheets

IGNITION AND FUEL SHUTOFF FOR ENGINE

CROSS-REFERENCE TO RELATED APPLICATIONS

This application claims the benefit of U.S. Provisional Patent Application No. 61/046,911 filed Apr. 22, 2008, the entire contents of which are hereby incorporated by reference herein.

BACKGROUND

The present invention relates to an ignition shutoff device and a fuel supply shutoff device for an engine.

An ignition shutoff device for an engine, such as a lawnmower engine, grounds the ignition coil to prevent firing of the spark plug to kill the engine, or to prevent the engine from starting. During transport of an engine-driven product, fuel may move from the fuel tank into the combustion chamber and crankcase, which can wash away and dilute engine oil causing damage to the engine. Engine-driven products may include, but are not limited to, lawnmowers, edgers, augers, snow throwers, tillers, chippers, log splitters, generators and pressure washers, for example.

SUMMARY

In one embodiment, the invention provides a carburetor assembly including a carburetor, a fuel supply valve, a valve member and a normally open switch. The carburetor includes a housing and is configured to supply fuel to a combustion chamber of an engine. The fuel supply valve is coupled to the carburetor housing and is fluidly connected to the carburetor upstream of the carburetor. The fuel supply valve includes a lever configured to pivot about a pivot axis between a first position and a second position. The lever includes a pivot portion through which the pivot axis passes and a handle portion fixed to the pivot portion and extending generally radially from the pivot portion in a direction. The pivot portion is configured to pivot about the pivot axis when an external force is applied to the handle portion. The valve member is configured to move in response to the lever such that fuel is allowed to flow to the carburetor when the lever is in the first position and fuel is not allowed to flow to the carburetor when the lever is in the second position. The normally open switch is adjacent the fuel supply valve and includes a switch actuator configured to move between an actuated position and a non-actuated position. The switch actuator is biased to the non-actuated position. The lever is configured to engage and release the switch actuator to move the switch actuator between the non-actuated position and the actuated position respectively when the lever moves between the first and second positions.

In another embodiment the invention provides a carburetor assembly including a carburetor, a fuel valve, a valve member and a normally open switch. The carburetor includes a housing and is configured to supply fuel to an engine for combustion. The fuel valve is coupled to the carburetor housing and is configured to allow and prevent fuel flow to the carburetor. The fuel valve includes a lever configured to pivot about an axis between a first position and a second position. The lever includes a pivot through which the axis passes and a handle fixed to the pivot and extending away from the pivot in a direction. The pivot is configured to pivot about the axis when a force is applied to the handle. The valve member is coupled with the lever such that fuel is allowed to flow to the carburetor when the lever is in the first position and fuel is prevented from flowing to the carburetor when the lever is in the second position. The normally open switch is adjacent the fuel valve and includes a switch actuator configured to move between an actuated position and a non-actuated position. The switch actuator is biased to the non-actuated position. The lever is configured to press and release the switch actuator to move the switch actuator between the non-actuator position and the actuator position when the lever moves between the first and second positions.

In another embodiment the invention provides a fuel and ignition shutoff system for an internal combustion engine including a carburetor shutoff valve, a valve member and a normally open switch. The carburetor shutoff valve is configured to selectively prevent and allow fuel from entering a carburetor. The shutoff valve has a lever including a pivot portion pivotable about a pivot axis and a handle portion fixed to the pivot portion and extending generally radially from the pivot portion in a direction. The pivot portion is configured to pivot about the pivot axis when an external force is applied to the handle portion. The valve member is coupled with the lever such that fuel is allowed to flow to the carburetor when the lever is in the first position and wherein fuel is not allowed to flow to the carburetor when the lever is in the second position. The normally open switch is adjacent the carburetor shutoff valve, the switch including a switch actuator configured to move between an actuated position and a non-actuated position, the switch being electrically connected to ground and to an ignition coil such that the ignition coil is electrically connected to ground when the switch is in the actuated position. The lever is configured such that the actuator engages and releases the switch actuator to move the switch actuator between the non-actuated position and the actuated position respectively when the lever moves between the first and second positions. The lever engages the actuation arm when the lever is in the second position such that the actuation arm is placed in the actuated position and such that the ignition coil is grounded.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
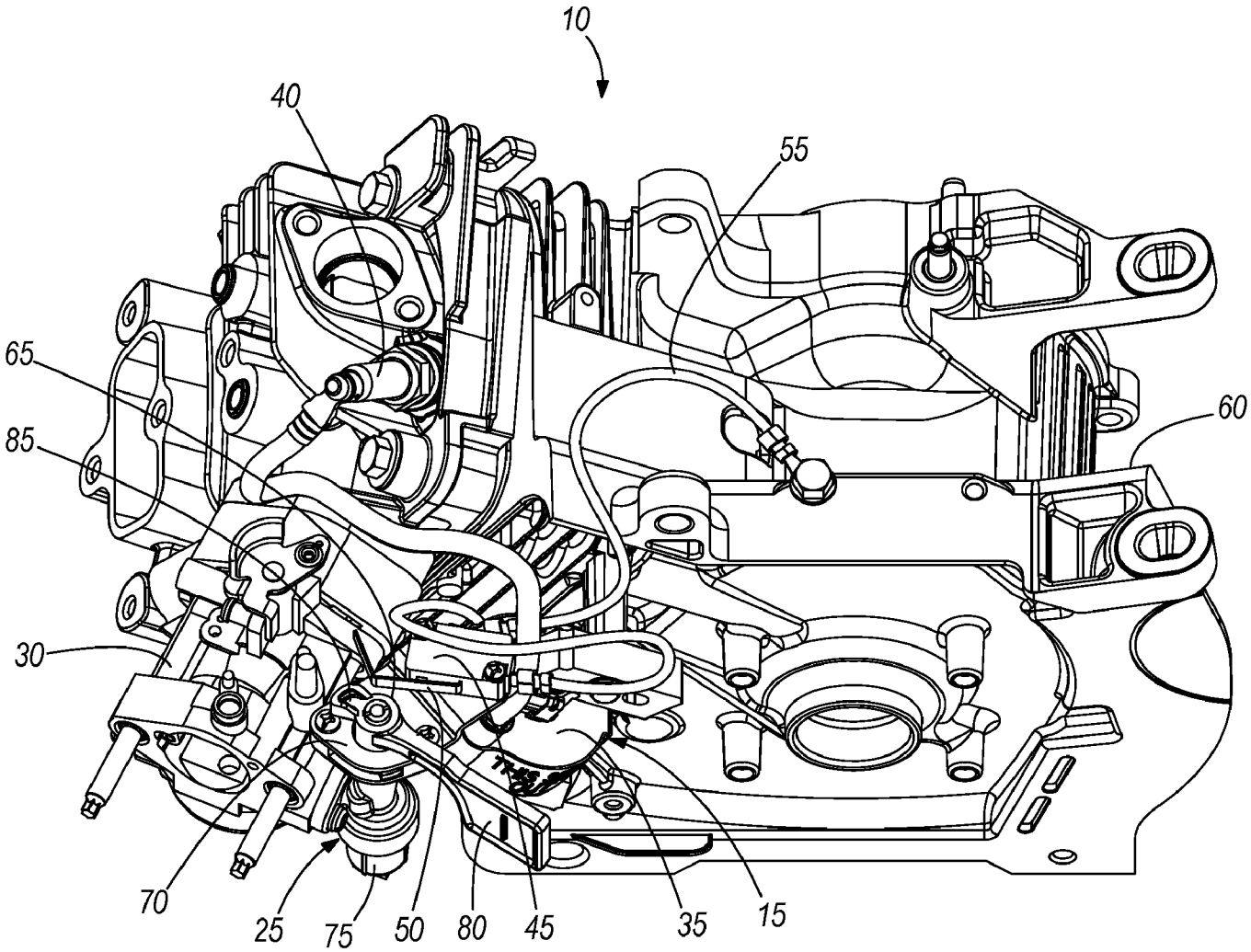
FIG. 1 is a perspective view of an engine including an ignition and fuel shutoff device in an open position.
Figure 5:
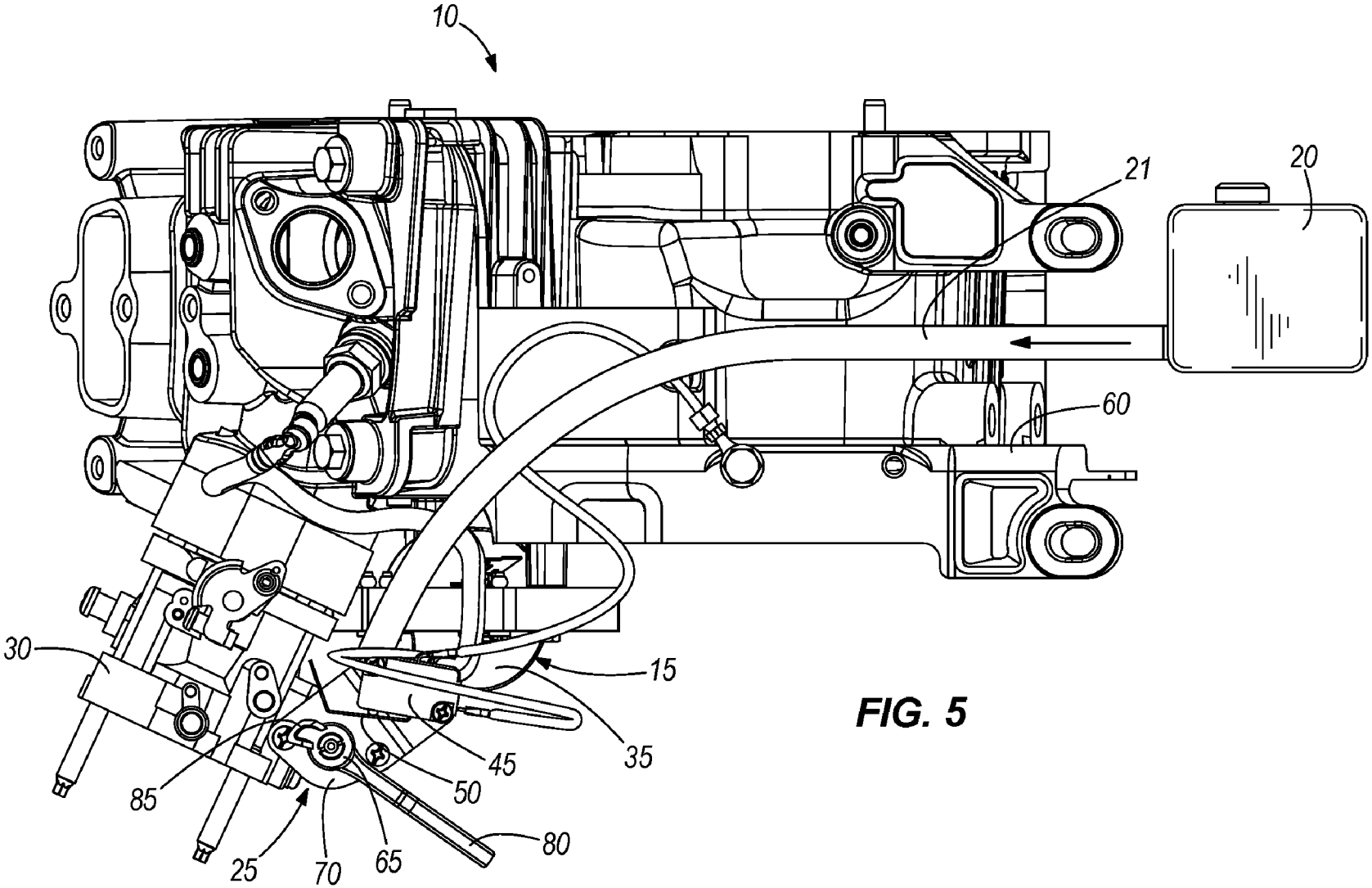
FIG. 5 is a top view of the engine of FIG. 1 including a fuel tank and fuel hose.

FIG. 1 shows an internal combustion engine 10 including an ignition system 15, and a fuel tank 20 (shown in FIG. 5) fluidly connected to a fuel supply valve 25 and a carburetor 30. The ignition system includes an ignition coil 35 electrically connected to a spark plug 40 and to a normally open switch 45, such as a microswitch. The microswitch includes an actuation arm 50 biased to the open position, i.e., the actuation arm 50 is biased away from contact with the microswitch 45. A wire 55 electrically connected to the microswitch 45 at one end is electrically connected to the engine block 60 at another end, i.e., ground. In an open microswitch condition, there is no electrical connection between the ignition coil 35 and the grounded wire 55. However, in a closed condition, the ignition coil 35 is electrically grounded by way of the wire 55. In other constructions, the switch may include other types of switches, and other actuators may be employed.

Figure 3:
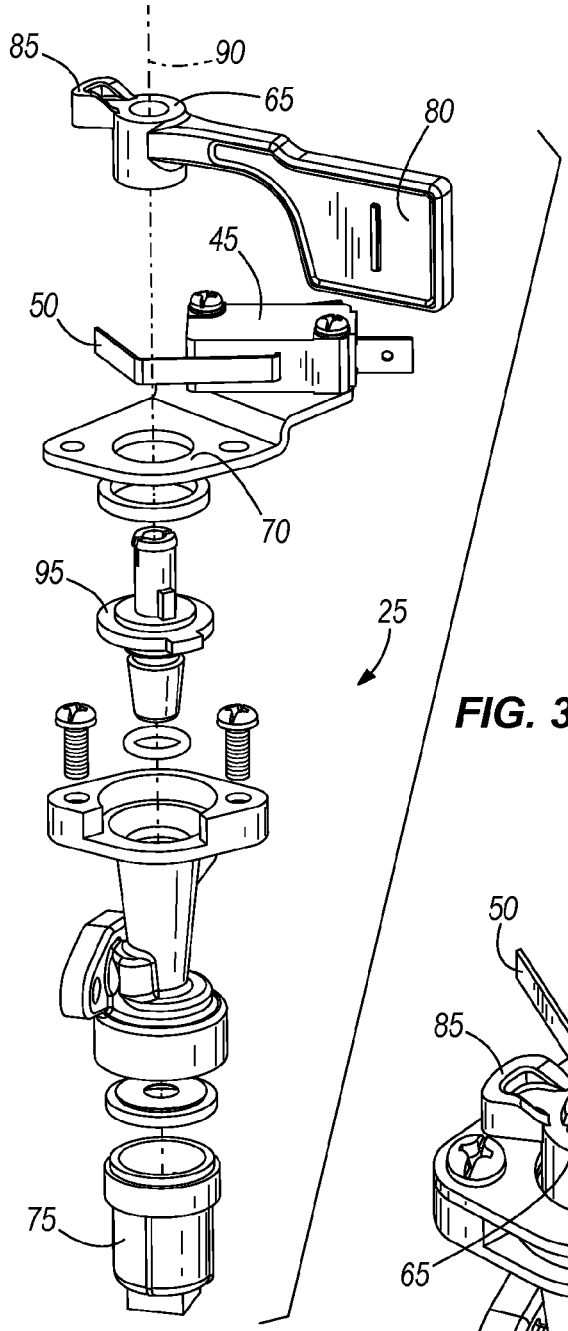
FIG. 3 is an exploded perspective view of the ignition and fuel shutoff device of FIG. 1.
Figure 4:
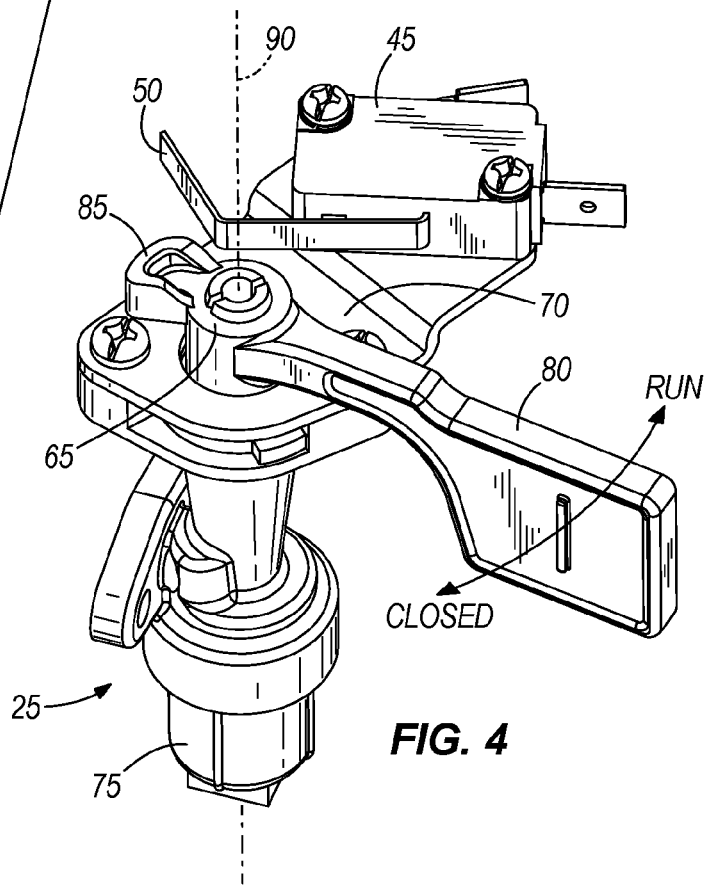
FIG. 4 is a perspective view of the ignition and fuel shutoff device of FIG. 3.

The fuel tank 20 (shown in FIG. 5) is fluidly connected to the carburetor 30 by a fuel hose 21 (also shown in FIG. 5) and the fuel supply valve 25, which in the illustrated construction is a petcock valve including a valve member 95 that allows and prevents the flow of fuel from the fuel tank 20 to the carburetor 30, and a lever 65 coupled to the valve member 95 and pivotable about a pivot axis 90 and positioned adjacent a bracket 70 coupled to the microswitch 45 (see FIGS. 3 and 4). The fuel supply valve 25 is coupled to a housing of the carburetor 30, which includes an optional sediment bowl 75, located adjacent the fuel supply valve 25 and centered about the pivot axis 90 in the illustrated construction. FIG. 1 illustrates the fuel supply lever 65 in the open position, allowing fuel to flow from the fuel tank 20 (shown in FIG. 5) to the carburetor 30 by way of the fuel hose 21 (also shown in FIG. 5) and the fuel supply valve 25. Referring now to FIGS. 3 and 4, the lever 65 includes a handle portion 80, an actuator 85, and the pivot axis 90 through a pivot portion between the handle portion 80 and the actuator 85. The handle portion 80 extends generally radially from the pivot portion in a first direction and is manually operable by a user to rotate the lever 65 about the pivot axis 90 with the application of an external force. The actuator 85 extends generally radially from the pivot portion in a second direction, the second direction preferably being opposite the first direction. In the open position shown in FIG. 1, the actuator 85 is not in contact with the actuation arm 50 of the microswitch 45, which is normally open. Therefore, the ignition coil 35 operates normally, providing a periodic high-voltage ignition signal to the spark plug 40. In other constructions, other types of valves having pivoting levers may be employed.

Figure 2:
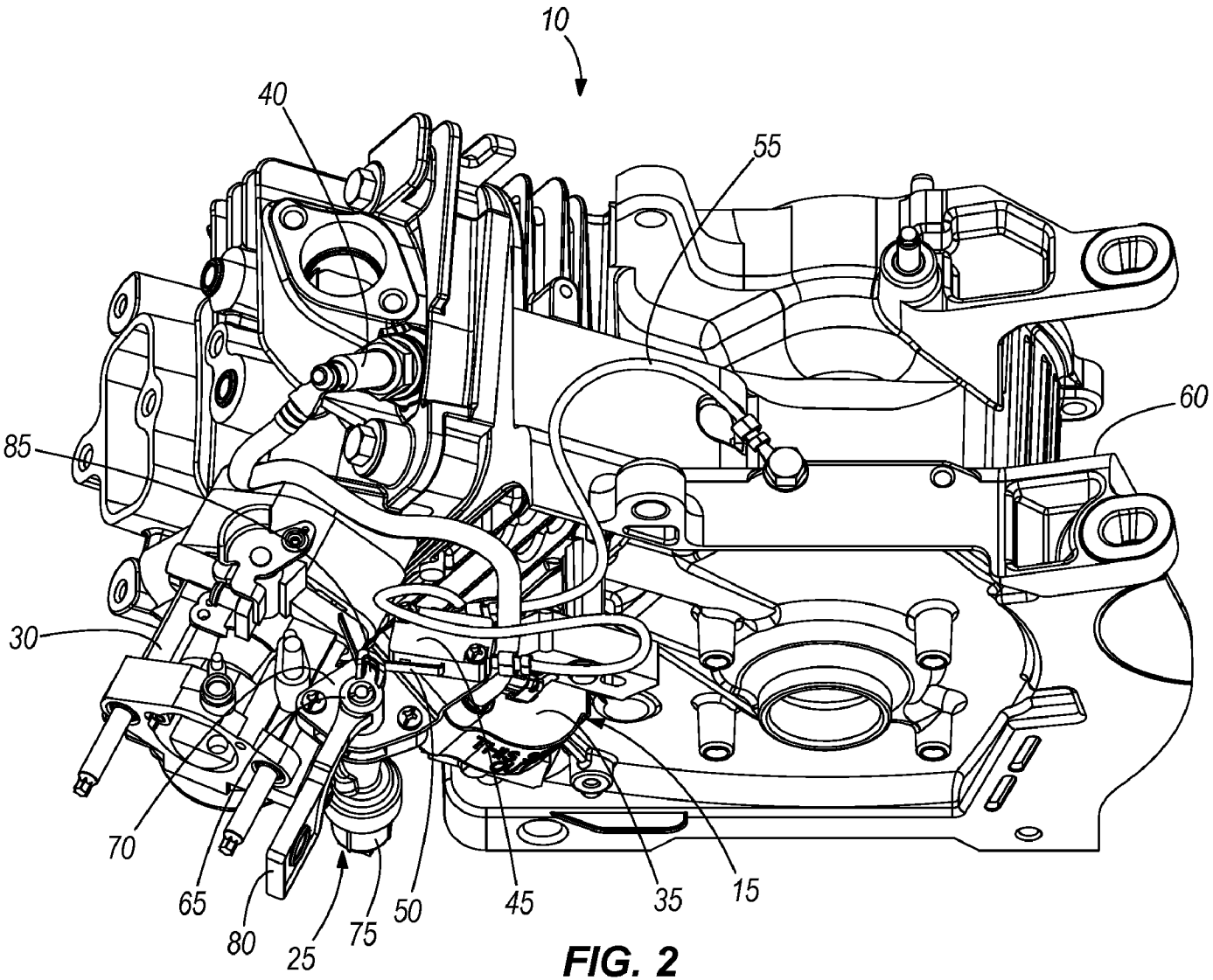
FIG. 2 is a perspective view of the engine including the ignition and fuel shutoff device in a closed position.

FIG. 2 illustrates the fuel supply lever 65 in the closed position, such that the closed fuel supply valve 25 inhibits the flow of fuel to the carburetor 30. As can be seen, the actuator 85 is in contact with the actuation arm 50 such that the actuation arm 50 is depressed so as to close the microswitch 45. In the closed microswitch position, the ignition coil 35 is electrically grounded and therefore firing of the spark plug does not occur. In other constructions, the actuator 85 may be positioned elsewhere with respect to the lever 65 and may extend in a direction not opposite the first direction, and in other constructions, the handle portion 80 may provide the actuation function.

In operation, the fuel supply lever 65 is positioned in the open position when operation of the engine 10 is desired. In the open position, fuel is supplied to the carburetor 30, and the microswitch 45 is open, allowing the ignition coil 35 to provide a periodic high-voltage ignition signal to the spark plug 40. When the engine 10 is to be shut down, the fuel supply lever 65 is pivoted about the pivot axis 90 to the closed position. In the closed position, the actuator 85 is pivoted into contact with the actuation arm 50 of the microswitch 45, such that the microswitch 45 is closed. When the microswitch 45 is closed, the ignition coil 35 is grounded and therefore unable to provide an ignition signal to the spark plug 40. The engine 10 is therefore unable to run. The fuel supply valve 25 is also closed, preventing the movement of excess fuel into the carburetor 30, thereby preventing the movement of excess fuel into the combustion chamber and crankcase.

Excess fuel can move to the combustion chamber and crank case during transport of the engine due to tilting during handling and positioning of the equipment and jostling from transportation. Frequent transport is common for equipment that is shared or used in many locations, such as rental equipment and equipment owned by landscapers and other contractors. Therefore, the engine cylinder(s) should be protected from a condition in which fuel removes the lubricating oil from the surfaces of the cylinder, causing the cylinder to lock. The engine bearings in the crankcase are also protected from a condition in which fuel seeps into the crankcase and dilutes the engine oil. The movement of fuel may otherwise occur during transport when the fuel supply valve is inadvertently left open. Furthermore, only one step is required to shut off the ignition system 15 and the fuel supply valve 25 because the fuel supply valve 25 is always closed when the ignition system 15 is shut off. When the ignition system 15 is enabled, the fuel supply valve 25 is always open. The lever 65 can be pivoted back to the open position when ignition is desired to start the engine.

Thus, the invention provides, among other things, an ignition and fuel shutoff lever.

What is claimed is:

1. A carburetor assembly, comprising:

a carburetor having a housing, the carburetor configured to supply fuel to an engine for combustion;

a fuel valve coupled to the carburetor housing and configured to allow and prevent fuel flow to the carburetor, the fuel valve including:

a lever configured to pivot about an axis between a first position and a second position, the lever including:

a pivot through which the axis passes;

a handle fixed to the pivot and extending away from the pivot in a direction;

wherein the pivot is configured to pivot about the axis when a force is applied to the handle;

a valve member coupled with the lever such that fuel is allowed to flow to the carburetor when the lever is in the first position and fuel is prevented from flowing to the carburetor when the lever is in the second position, wherein the valve member rotates about the pivot axis in response to the lever moving between the first position and the second position; and a normally open switch adjacent the fuel valve, the switch including a switch actuator configured to move between an actuated position and a non-actuated position, wherein the switch actuator is biased to the non-actuated position;

wherein the lever is configured to one of press and not press the switch actuator to move the switch actuator between the actuated position and the non-actuated position when the lever moves between the first and second positions.

2. The carburetor assembly of claim 1, wherein the lever further includes a lever actuator fixed to the pivot and extending away from the pivot in a second direction, wherein the lever actuator is configured to move about the axis when a force is applied to the handle, and wherein the lever actuator is configured to one of press and not press the switch actuator to move the switch actuator between the actuated position and the non-actuated position respectively when the lever moves between the first and second positions.

3. The carburetor assembly of claim 2, wherein the second direction is generally opposite the first direction.

4. The carburetor assembly of claim 1, further comprising a sediment bowl next to the fuel valve.

5. The carburetor assembly of claim 1, wherein the sediment bowl is centered about the axis.

6. The carburetor assembly of claim 1, wherein the switch is electrically connected to ground and to an ignition coil such that the ignition coil is electrically grounded when the switch is in the actuated position.

7. The carburetor assembly of claim 6, wherein the switch is configured to disconnect the ignition coil from ground when the switch is in the non-actuated position.

8. The carburetor assembly of claim 6, wherein the lever presses the switch actuator when the lever is in the first position to move the switch to the actuated position, thereby grounding the ignition coil.

9. The carburetor assembly of claim 1, further comprising a bracket next to the lever, the bracket including a switch mounting portion, wherein the switch is mounted to the switch mounting portion.

10. The carburetor assembly of claim 9, the bracket further including a lever mounting portion adjacent the switch mounting portion, the lever mounting portion having a hole, wherein a portion of the lever assembly passes through the hole, and wherein the axis passes through the hole.

11. The carburetor assembly of claim 1, wherein the switch is a microswitch, and wherein the switch actuator is an actuation arm.

12. A fuel and ignition shutoff system for an internal combustion engine, comprising:

a carburetor shutoff valve configured to selectively prevent and allow fuel from entering a carburetor, the shutoff valve having a lever including:

a pivot portion pivotable about a pivot axis;

a handle portion fixed to the pivot portion and extending generally radially from the pivot portion in a direction;

wherein the pivot portion is configured to pivot about the pivot axis when an external force is applied to the handle portion;

a valve member aligned with the pivot axis and configured for co-rotation with the lever such that fuel is allowed to flow to the carburetor when the lever is in the first position and wherein fuel is not allowed to flow to the carburetor when the lever is in the second position; and a normally open switch adjacent the carburetor shutoff valve, the switch including a switch actuator configured to move between an actuated position and a non-actuated position, the switch being electrically connected to ground and to an ignition coil such that the ignition coil is electrically connected to ground when the switch is in the actuated position, wherein the lever is configured such that the lever one of engages and does not engage the switch actuator to move the switch actuator between the actuated position and the non-actuated position respectively when the lever moves between the first and second positions, wherein the lever engages the switch actuator when the lever is in the first position such that the switch actuator is placed in the actuated position and such that the ignition coil is grounded.

13. The fuel and ignition shutoff system of claim 12, the lever further including a lever actuator fixed to the pivot portion and extending generally radially from the pivot portion in a second direction, wherein the lever actuator is configured to move about the pivot axis when an external force is applied to the handle portion, and wherein the lever actuator is configured to one of engage and not engage the switch actuator to move the switch actuator between the actuated position and the non-actuated position respectively when the lever moves between the first and second positions.

14. The fuel and ignition shutoff system of claim 13, wherein the second direction is generally opposite the first direction.

15. The fuel and ignition shutoff system of claim 12, further comprising a sediment bowl centered about the pivot axis.

16. The fuel and ignition shutoff system of claim 12, wherein the switch is configured to disconnect the ignition coil from ground when the switch is in the non-actuated position.

17. The fuel and ignition shutoff system of claim 12, further comprising a bracket adjacent the lever, the bracket including a switch mounting portion, wherein the switch is mounted to the switch mounting portion.

18. The carburetor assembly of claim 17, the bracket further including a lever mounting portion adjacent the switch mounting portion, the lever mounting portion having an aperture therethrough, wherein a portion of the fuel shutoff valve passes through the aperture, and wherein the pivot axis passes through the aperture.

19. The carburetor assembly of claim 12, wherein the switch actuator is biased to the non-actuated position.

* * * * *